US009772137B2

(12) United States Patent
Diaco

(10) Patent No.: US 9,772,137 B2
(45) Date of Patent: Sep. 26, 2017

(54) PORTABLE WATER COOLER

(71) Applicant: Ralph Diaco, Paterson, NJ (US)

(72) Inventor: Ralph Diaco, Paterson, NJ (US)

( * ) Notice: Subject to any disclaimer, the term of this patent is extended or adjusted under 35 U.S.C. 154(b) by 30 days.

(21) Appl. No.: 14/255,063

(22) Filed: Apr. 17, 2014

(65) Prior Publication Data

US 2015/0300730 A1 Oct. 22, 2015

(51) Int. Cl.
*F25D 31/00* (2006.01)
*F25D 3/08* (2006.01)

(52) U.S. Cl.
CPC ..... *F25D 31/002* (2013.01); *F25D 3/08* (2013.01)

(58) Field of Classification Search
CPC ..... F25D 3/08; F25D 31/002
USPC ..... 62/389, 400
See application file for complete search history.

(56) References Cited

U.S. PATENT DOCUMENTS 23,605 A * 4/1859 Phelps ..... F25D 3/08 137/259
652,271 A * 6/1900 Howe ..... B65D 81/3222 222/129
1,004,490 A * 9/1911 Steel ..... F25D 3/08 62/400
1,183,197 A * 5/1916 Henderson ..... 62/397
1,248,705 A * 12/1917 Pogue ..... F25D 3/107 141/330
1,300,432 A * 4/1919 McDonald ..... 62/297
1,381,341 A * 6/1921 Royster ..... F25D 31/002 222/131
1,489,754 A * 4/1924 Fruen ..... F25D 3/08 222/184
2,540,756 A * 2/1951 Radcliffe ..... B65D 25/20 220/592.03
2,551,842 A * 5/1951 Kirchner ..... B67D 3/0009 222/129
4,204,613 A * 5/1980 Terzian ..... B67D 3/0009 165/163
4,458,584 A * 7/1984 Annese ..... B01F 1/0022 220/521
4,608,837 A * 9/1986 Hickey ..... B65D 25/02 62/390
4,858,786 A * 8/1989 Eagar ..... B67D 3/0012 222/158
5,280,764 A * 1/1994 Levinrad ..... B67D 3/0032 141/330
5,328,050 A * 7/1994 Hyatt ..... B67D 3/0022 220/506
5,341,657 A * 8/1994 Fuller ..... B67D 3/0009 220/754
6,536,733 B1 * 3/2003 Sharp ..... A45B 11/00 248/519
2004/0212120 A1 * 10/2004 Giraud ..... A47G 19/2288 264/102

(Continued)

*Primary Examiner* — Dominick L Plakkoottam
*Assistant Examiner* — Kirstin Oswald
(74) *Attorney, Agent, or Firm* — Porzio Bromberg & Newman P.C.

(57) ABSTRACT

A portable water cooler including a cooler housing having guides for expeditiously receiving a water jug and ice to surround the water jug after it is received within the housing. A cooler lid can be removably coupled to the cooler housing after receiving the water jug and ice. A water dispensing faucet is sealed to the received water jug to provide a sealed environment.

11 Claims, 2 Drawing Sheets

(56) References Cited

U.S. PATENT DOCUMENTS

2008/0237260 A1* 10/2008 Wolek ..... B67D 3/0009
222/105

* cited by examiner

PORTABLE WATER COOLER

BACKGROUND OF THE INVENTION

Field of the Invention

The present invention relates to a portable water cooler for efficiently receiving an inverted water jug and ice to surround the water jug in which a sealed environment is created.

Description of Related Art

Water coolers are known which include enclosures or compartments for ice. U.S. Pat. No. 648,904 describes a cylindrical form adapted to be removably supported within an enclosure, leaving a free space between the receptacle and the enclosure-walls adapted to contain a supply of cracked ice for maintaining the water at a low temperature. Drip water from melted ice can be drawn off with a petcock. This system is stationary and cumbersome. Further, this patent has the shortcomings of not providing a portable housing and not providing a sealed environment within the cooler.

U.S. Pat. No. 1,004,490 describes a cooler providing means confining a refrigerant, such as ice, wholly around a bottle. A water cooler includes a casing having an opening therein at one end. A water receptacle is located in the casing and spaced from the walls thereof and is provided at one end with a neck portion which extends through the opening in the casing. A rest is located in the casing and wholly supports the water receptacle. A depending collar is formed on the rest and extends into the opening in the casing. The bottom of the bottle rests directly upon the seat formed upon the bottom member. This construction is desirable so that the bottom is spaced from the bottom member so as to form a drain space. In inserting a full bottle in the chamber, the bottle is set in an upright position, after which, the casing of the cooler is inverted and placed over the bottle so as to cause the neck of the bottle to extend through the opening. When these parts are properly assembled with each other the cooler is placed in its operative position, after which, the ice chamber is inserted in the chamber. A drain chamber which is in direct communication with the ice chamber allows the weight of water from the ice to circulate about the collar which can be used to cool that portion of the bottle immediately adjacent the discharge end thereof. This patent has the drawback that ice is not received around the neck of the bottle for cooling of the water exiting from the bottle. Also, this water cooler is not portable and does not provide a sealed environment with the received water bottle.

It is desirable to provide an improved portable water cooler which provides guidance for receiving an inverted water jug and allows ice to surround the received water jug in which a sealed environment is created.

SUMMARY OF THE INVENTION

The present invention relates to a portable water cooler in which a cooler housing provides guides for expeditiously receiving a water jug and ice to surround the water jug after it is received within the housing. A cooler lid can be removably coupled to the cooler housing after receiving the water jug and ice. The cooler housing and cooler lid can be formed of a light weight insulating material. A water dispensing faucet is sealed to the received water jug to provide a sealed environment.

In one embodiment, a receiving jacket mount provides alignment of the water jug with a faucet tube connected or integral with a water dispensing faucet. The faucet tube pierces a bottom of the water jug to seal the water jug to the dispensing faucet. The dispensing faucet can be opened to allow water to be removed from the water jug. A drain valve is positioned near a bottom of the cooler housing for draining water of melted ice from the cooler housing. The water dispensing faucet is positioned at a side of the cooler housing to allow water to be dispensed from the jug while the cooler housing is resting on a surface, such as a table or counter.

The invention will be more fully described by reference to the following drawings.

DETAILED DESCRIPTION

Figure 1:
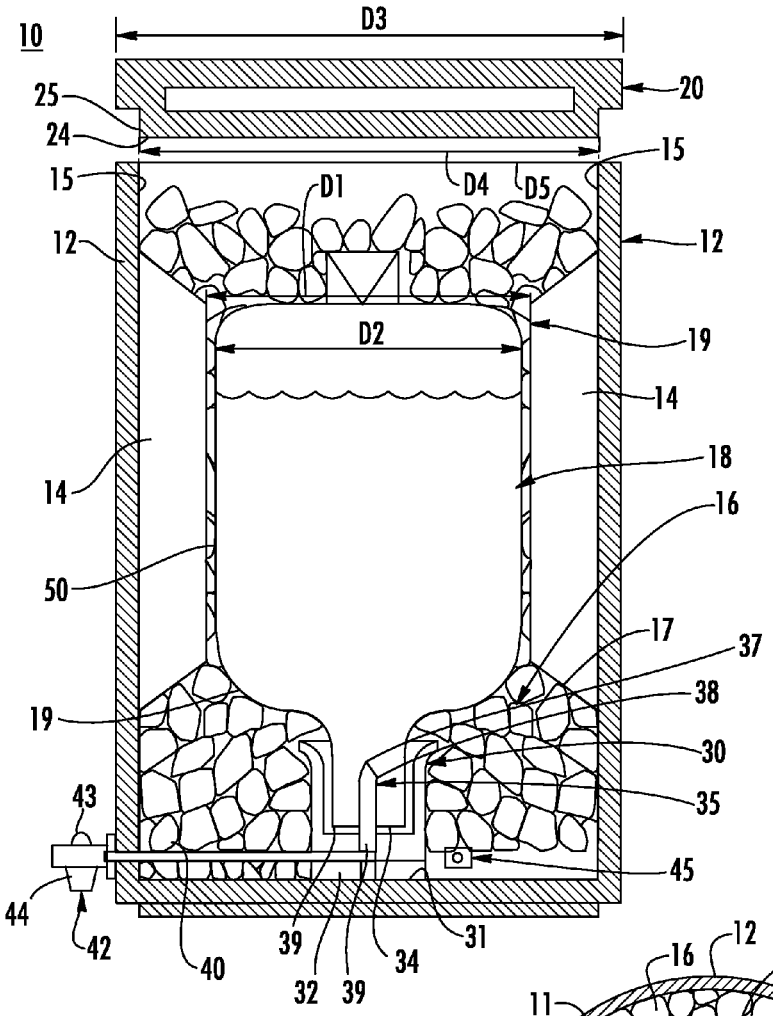
FIG. 1 is a schematic diagram of a water cooler in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 illustrates portable water cooler 10 in accordance with the teachings of the present invention. Cooler housing 12 includes guides 14 removably coupled or integral with inner surface 15 of cooler housing 12. At least two guides 14 extend radially from inner surface 15 of cooler housing 12. In one embodiment, three guides 14 extend radially from inner surface 15. It will be appreciated that additional guides 14 can be used in accordance with the teachings of the present invention.

Figure 2:
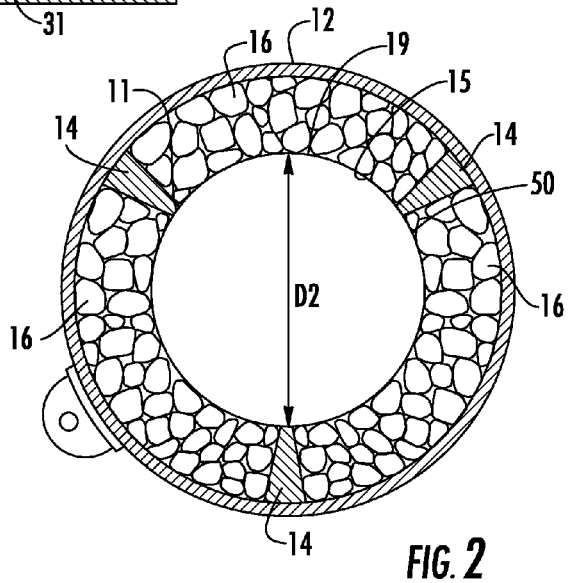
FIG. 2 is a top plan view of the water cooler.

Guides 14 form compartments 16 between inner surface 15 of cooler housing 12 and outer surface 19 of water jug 18 as shown in FIG. 2. Compartments 16 can be used for receiving ice 17 as shown in FIG. 2. Cooler housing 12 is dimensioned to have a diameter $D_1$ from end 11 of guides 14 that is substantially or slightly larger than diameter $D_2$ of water jug 18. For example water jug 18 can have a diameter of a conventional 5 gallon water jug of spring water as manufactured by POLAND SPRING™.

Figure 3:
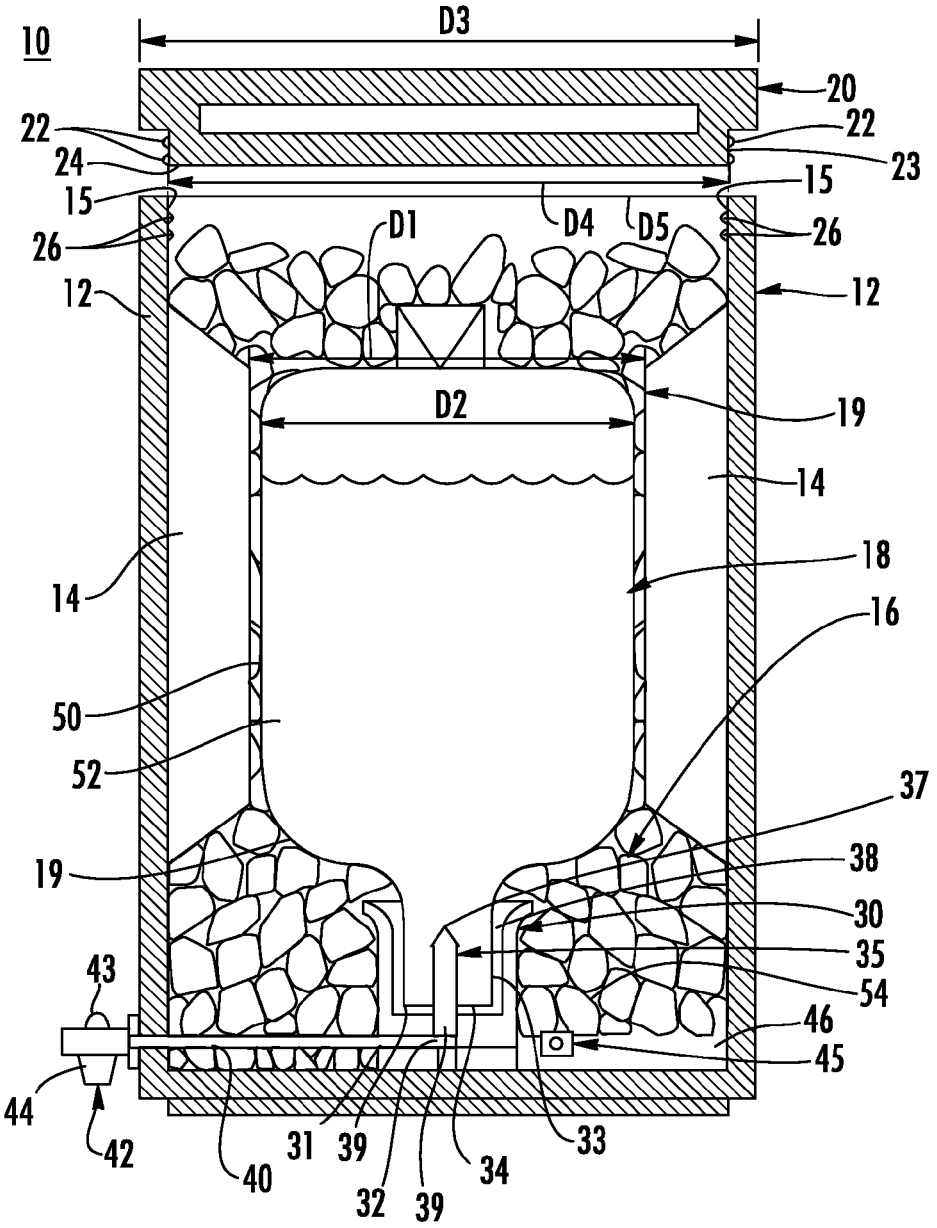
FIG. 3 is a schematic diagram of an alternate embodiment of a water cooler and a lid in accordance with the teachings of the present invention.

Cooler lid 20 is removably coupled to cooler housing 12, as shown in FIG. 1. Cooler lid 20 has outer diameter $D_3$ and inner diameter $D_4$. Inner diameter $D_4$ can be slightly smaller than inner diameter $D_5$ of inner surface 15 of cooler housing 12 to provide friction closing of cooler lid 20 to cooler housing 12. Alternatively, cooler lid 20 can include ridges 22 on outer surface 23 of lip 24 to be screwed to corresponding ridges 26 of cooler housing 12 to provide coupling of cooler lid 20 to cooler housing 12 as shown in FIG. 3.

Cooler housing 12 and cooler lid 20 can be formed of a light weight insulated material. Suitable materials for cooler housing 12 and cooler lid 20 include plastic or reclaimed plastic from an industrial manufacturing processes, such as for example high-density polyethylene. Cooler housing 12 and cooler lid 20 can include an insulation, such as for example polyurethane foam. Referring to FIG. 1, inner surface 15 of cooler housing 12 and inner surface 25 of cooler lid 20 can be formed of smooth plastic, such as for example polypropylene or a FDA-grade polypropylene.

Receiving jacket mount 30 is positioned at inner bottom surface 31 of cooler housing 12. Receiving jacket mount 30 includes walls 29 extending upwardly from base 32. Receiving jacket mount 30 guides neck 33 of received water jug 18 within walls 29 over faucet tube 35. Receiving jacket mount 30 can be formed of a non-insulating material to allow ice received in compartments 16 adjacent to receiving jacket mount 30 to cool neck 33.

Seal 34 seals neck 33 of jug 18. For example seal 34 can be formed of plastic. Faucet tube 35 includes pointed apex 37 at end 38. End 39 of faucet tube 35 is coupled or integral with drain pipe 40. Drain pipe 40 connects to water dispensing faucet 42. Water dispensing faucet 42 can include activation button 43 for opening and closing water dispensing faucet 42. Spigot 44 extends from water dispensing faucet 42. Drain valve 45 is positioned with wall 46 of cooler housing 12 adjacent inner bottom surface 31 of cooler housing 12.

During use, cooler lid 20 is removed from cooler housing 12. Water jug 18 is inverted. Outer surface 50 of water jug 18 is guided by guides 14 into cooler housing 12. Neck 33 is received in receiving jacket mount 30. Pointed apex 37 of faucet tube 35 pierces seal 34 to seal water jug 18 to faucet tube 35 to provide a sealed environment. Ice 17 is received in compartments 16. Cooler lid 20 closes cooler housing 12 to provide an insulated environment. Dispensing faucet 42 can be opened by depressing activation button 43 to allow water 52 to be removed from water jug 18. Drain valve 45 is opened for draining water 54 of melted ice from cooler housing 12. Ice 17 can be replenished by opening cooler lid 20 and pouring ice into compartments 16. Portable water cooler 10 can transported with or without jug 18 to a desired location. Portable water cooler 10 can be placed for example on a table or counter to allow water 52 to be dispensed from water jug 18 through dispensing faucet 40 and water 54 to be removed using drain valve 45 while cooler housing 12 is resting on the table or counter.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A portable water cooler comprising;

a portable cooler housing, a plurality of guides radially extending from an inner surface of said cooler housing, said guides configured for extending a distance which is the same or larger than a diameter of a sealed water jug received within the cooler housing for guiding the received sealed water jug within said cooler housing and forming compartments between adjacent said guides and an inner wall of the cooler housing and an outer wall of the jug, said compartments configured for extending along the entire length of the received water jug, a receiving jacket mount positioned at an inner bottom surface of said cooler housing, said receiving jacket mount includes a continuous circumferential wall extending from a base, a faucet tube positioned at a bottom inner surface of said cooler housing, said faucet tube extending through said base within said continuous circumferential wall, said receiving jacket mount configured to guide a neck of said received jug within said wall over said faucet tube, said faucet tube having a first end and a second end, the first end of said faucet tube being coupled to or integral with a dispensing faucet, said second end of said faucet tube being a pointed apex and said pointed apex being configured for piercing a seal of the received sealed water jug to allow water to flow to the dispensing faucet in a sealed environment within said wall of said receiving jacket mount, and a cooler lid adapted to be coupled to said open end of said cooler housing to provide closing of the cooler housing, wherein said compartments being adapted for receiving ice for surrounding the water jug and said cooler housing is closed by said cooler lid after said ice is received in said compartments and wherein said cooler housing and said cooler lid are formed of plastic.

2. The portable water cooler of claim 1 comprising three guides.

3. The portable water cooler of claim 1 wherein the cooler lid has an outer diameter sufficiently smaller than a diameter of an inner surface of said cooler housing to provide friction closing of said cooler lid to said cooler housing.

4. The portable water cooler of claim 1 wherein the cooler lid having one or more first ridges on an outer surface of a lip of said cooler lid and said cooler housing having one or more corresponding second ridges at an inner surface of a top portion of said cooler housing, wherein said one or more first ridges of said cooler lid can be screwed to said one or more second ridges of said cooler housing to provide coupling of said cooler lid to said cooler housing.

5. The portable water cooler of claim 1 wherein said cooler housing and said cooler lid are formed of an insulated material.

6. The portable water cooler of claim 1 wherein said cooler housing and said cooler lid are formed of high-density polyethylene.

7. The portable water cooler of claim 1 wherein an inner surface of said cooler housing and an inner surface of said cooler lid are formed of polypropylene or a FDA-grade polypropylene.

8. The portable water cooler of claim 1 wherein said receiving jacket mount is formed of a non-insulating material.

9. The portable water cooler of claim 1 further comprising a drain valve positioned in a wall of the cooler housing adjacent to an inner bottom surface of said cooler housing.

10. The portable water cooler of claim 1 further comprising a water dispensing faucet coupled to said faucet tube.

11. The portable water cooler of claim 10 further comprising an activate button for opening and closing the water dispensing faucet.

* * * * *